US011629019B2

(12) United States Patent
Morita et al.

(10) Patent No.: US 11,629,019 B2
(45) Date of Patent: Apr. 18, 2023

(54) MEDIUM FEEDING APPARATUS

(71) Applicant: RISO KAGAKU CORPORATION, Tokyo (JP)

(72) Inventors: Yoshihisa Morita, Tsukuba (JP); Yoshiyuki Okada, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 43 days.

(21) Appl. No.: 17/154,039

(22) Filed: Jan. 21, 2021

(65) Prior Publication Data

US 2021/0261369 A1 Aug. 26, 2021

(30) Foreign Application Priority Data

Feb. 26, 2020 (JP) ..... JP2020-030533

(51) Int. Cl.

| | |
|---|---|
| ***B65H 3/48*** | (2006.01) |
| ***B65H 7/04*** | (2006.01) |
| ***B65H 3/12*** | (2006.01) |
| ***B65H 3/14*** | (2006.01) |
| *B65H 5/22* | (2006.01) |

(52) U.S. Cl.

CPC ..... *B65H 7/04* (2013.01); *B65H 3/128* (2013.01); *B65H 3/14* (2013.01); *B65H 3/48* (2013.01); *B65H 5/228* (2013.01)

(58) Field of Classification Search

CPC ..... B65H 3/48; B65H 2406/323; B65H 5/228
See application file for complete search history.

(56) References Cited

U.S. PATENT DOCUMENTS

| | | | | |
|---|---|---|---|---|
| 7,913,993 | B2 * | 3/2011 | Kosugi | B65H 3/48 271/98 |
| 8,141,865 | B2 * | 3/2012 | Utagawa | B65H 3/128 271/31 |
| 2005/0040584 | A1 * | 2/2005 | Isemura | B65H 3/48 271/97 |
| 2012/0049437 | A1 | 3/2012 | Matsumoto et al. | |
| 2017/0160689 | A1 * | 6/2017 | Sugawara | B65H 7/14 |
| 2021/0016988 | A1 * | 1/2021 | Yamaguchi | B65H 7/02 |

FOREIGN PATENT DOCUMENTS

| | | |
|---|---|---|
| JP | 2012-46279 | 3/2012 |

* cited by examiner

*Primary Examiner* — Howard J Sanders
(74) *Attorney, Agent, or Firm* — Greenblum & Bernstein, P.L.C.

(57) ABSTRACT

A medium feeding apparatus includes: a placement mount on which a plurality of media are placed; a transportation mechanism that transports an uppermost medium of the plurality of media placed on the placement mount; a floating-air blowout mechanism that blows out air to float at least the uppermost medium; a suction mechanism that sucks air to cause the uppermost medium floated by the floating-air blowout mechanism blowing out air to be attracted to the transportation mechanism; and a floating-air control unit that causes the floating-air blowout mechanism to start to blow out air while the uppermost medium is being attracted to the transportation mechanism after starting to be transported by the transportation mechanism, so as to float at least a second medium located below the uppermost medium, and causes the floating-air blowout mechanism to stop blowing out air before the second medium starts to be transported by the transportation mechanism.

19 Claims, 10 Drawing Sheets

| | PAPER QUALITY: STANDARD | | |
|---|---|---|---|
| | A5 | B5 | A4 |
| MEDIUM FEEDING INTERVALS | in10 | in20 | in30 |
| (a) LENGTHS OF TIME BEFORE MEDIUM COMES TO BE NO LONGER ATTRACTED TO TRANSPORTATION MECHANISM | p11 | p21 | p31 |
| (b) TIME LENGTHS REQUIRED FOR FLOATING | p12 | p22 | p32 |
| (c) TIME LENGTHS REQUIRED FOR FALL | p13 | p23 | p33 |
| REQUIRED TIME LENGTHS (＝a＋b＋c) | p14 (=p11+ p12+p13) | p24 (=p21+ p22+p23) | p34 (=p31+ p32+p33) |
| TIME LENGTHS EXCEEDING MEDIUM FEEDING INTERVALS | p15 (p14- in10) | p25 (p24- in20) | p35 (p34- in30) |

FIG. 4

MEDIUM FEEDING APPARATUS

CROSS-REFERENCE TO RELATED APPLICATION

This application is based upon and claims the benefit of priority of the prior Japanese Patent Application No. 2020-030533, filed on Feb. 26, 2020, the entire contents of which are incorporated herein by reference.

FIELD

The aspects described herein are related to a medium feeding apparatus.

BACKGROUND

Techniques conventionally proposed for sheet feeding apparatuses are such that when transferring a preceding sheet and a following sheet, the timing at which the following sheet is attracted to an attraction transporter is adjusted to allow the following sheet to be transported with a portion thereof overlapping the preceding sheet, which is attracted to the attraction transporter prior to the following sheet (see, for example, Japanese Laid-open Patent Publication No. 2012-46279).

SUMMARY

In an aspect, a medium feeding apparatus includes: a placement mount on which a plurality of media are placed; a transportation mechanism that transports an uppermost medium of the plurality of media placed on the placement mount; a floating-air blowout mechanism that blows out air to float at least the uppermost medium; a suction mechanism that sucks air to cause the uppermost medium floated by the floating-air blowout mechanism blowing out air to be attracted to the transportation mechanism; and a control unit that causes the floating-air blowout mechanism to start to blow out air while the uppermost medium is being attracted to the transportation mechanism after starting to be transported by the transportation mechanism, so as to float at least a second medium located below the uppermost medium, and causes the floating-air blowout mechanism to stop blowing out air before the second medium starts to be transported by the transportation mechanism.

The object and advantages of the present invention will be realized by the elements set forth in the claims or combinations thereof.

BRIEF DESCRIPTION OF DRAWINGS

FIG. 4 is a table for illustrating time lengths that exceed medium feeding intervals for various medium sizes in an embodiment;

DESCRIPTION OF EMBODIMENTS

Figure 1:
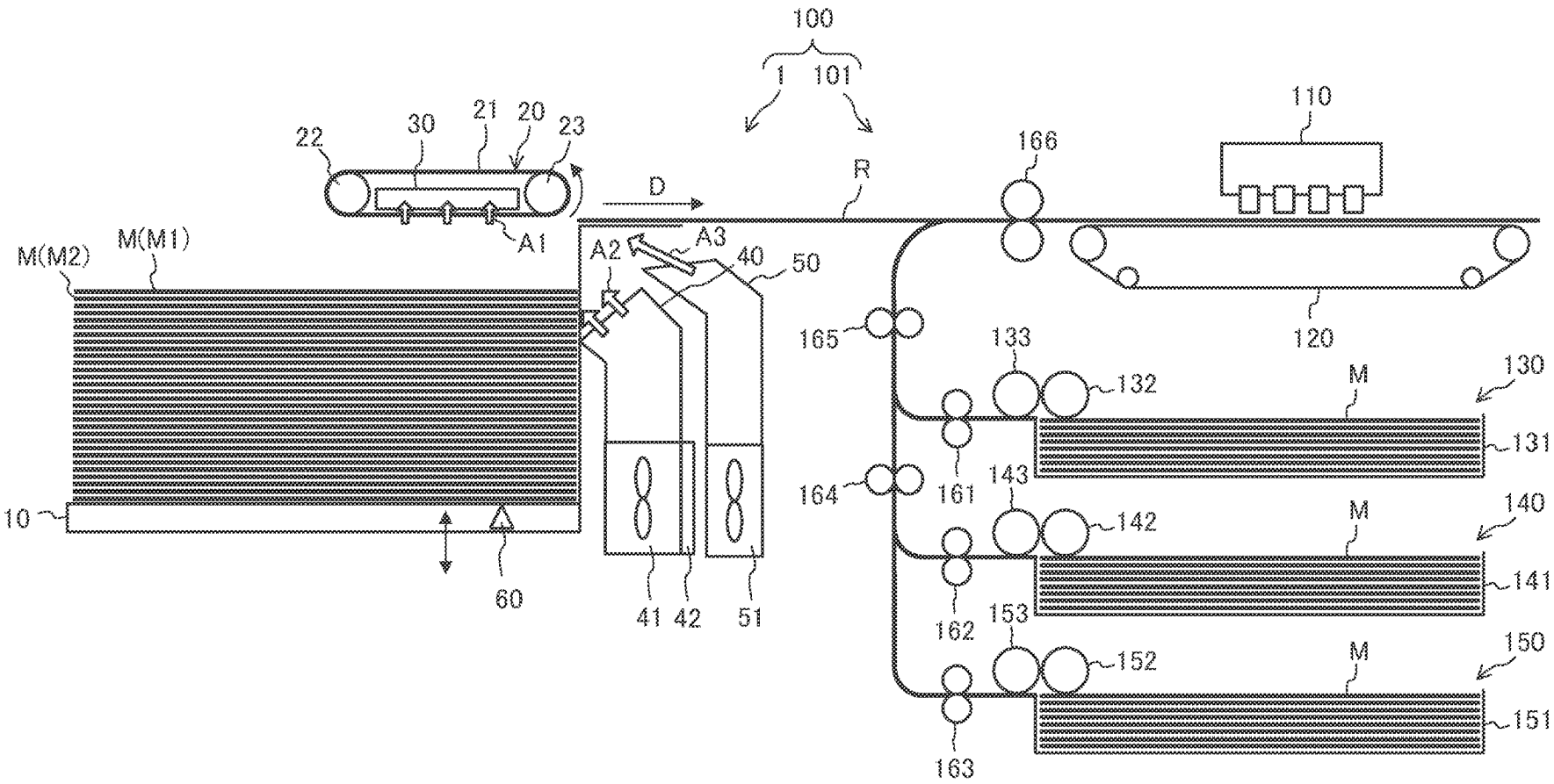
FIG. 1 is a configuration diagram illustrating a printing system that includes a medium feeding apparatus in accordance with an embodiment.

Now, consideration is given to a medium feeding apparatus that includes: a placement mount on which a plurality of media are placed; a transportation mechanism that transports an uppermost medium of the plurality of media placed on the placement mount; a floating-air blowout mechanism that blows out air to float at least the uppermost medium; and a suction mechanism that sucks air to cause the uppermost medium floated by the floating-air blowout mechanism blowing out air to be attracted to the transportation mechanism.

In such a medium feeding apparatus, the uppermost medium is transported until being no longer attracted to (until no longer facing) the transportation mechanism, and then a second medium located below the uppermost medium is floated by the floating-air blowout mechanism blowing out air, thereby preventing multi-feeding of the uppermost medium and the second medium.

However, floating the second medium after the uppermost medium comes to be no longer attracted to the transportation mechanism will involve a long time before the second medium is attracted to the transportation mechanism after the uppermost medium comes to be no longer attracted to the transportation mechanism. Thus, the start of transportation of the second medium will be delayed, thereby decreasing the efficiency of media feeding.

When a preceding sheet and a following sheet are transported while overlapping each other as seen in the sheet feeding apparatus described hereinabove, multi-feeding will occur afterward if these sheets cannot be separated from each other. A mechanism for stopping suction of sheets or control for stopping suction of sheets will be essential to suppress such multi-feeding.

The following describes a medium feeding apparatus in accordance with embodiments of the present invention by referring to the drawings.

FIG. 1 is a configuration diagram illustrating a printing system 100 that includes a medium feeding apparatus 1 in accordance with an embodiment.

Figure 2:
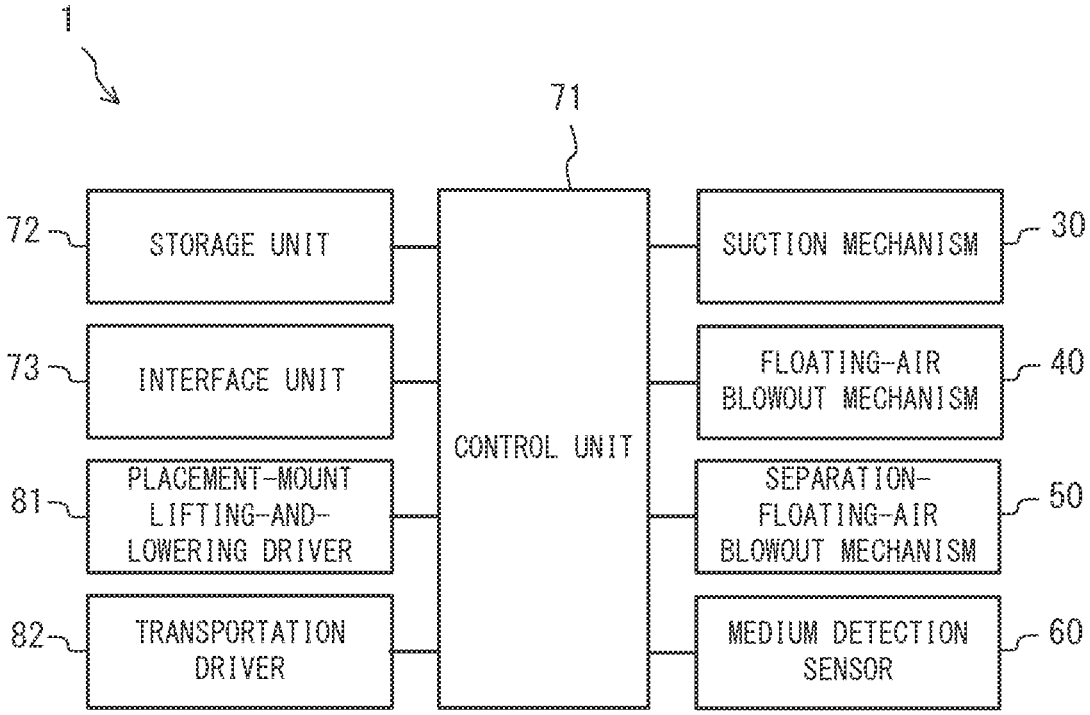
FIG. 2 illustrates the control configuration of a medium feeding apparatus in accordance with an embodiment.

FIG. 2 illustrates the control configuration of the medium feeding apparatus 1.

The printing system 100 depicted in FIG. 1 includes the medium feeding apparatus 1 and a printing apparatus 101.

The medium feeding apparatus 1 feeds media M to a printing unit 110 of the printing apparatus 101. The medium feeding apparatus 1 may feed media M not only to the printing apparatus 101 but also to another apparatus such as a transportation apparatus or a post-processing apparatus. The medium feeding apparatus 1 may be integral with another apparatus such as the printing apparatus 101. Media M are, for example, sheets (flat paper) but may be sheet-like media such as films.

As depicted in FIG. 1, the medium feeding apparatus 1 includes a placement mount 10, a transportation mechanism 20, a suction mechanism 30, a floating-air blowout mechanism 40, a separation-floating-air blowout mechanism 50, and a medium detection sensor 60.

As depicted in FIG. 2, the medium feeding apparatus 1 includes a control unit 71, a storage unit 72, an interface unit 73, a placement-mount lifting-and-lowering driver 81, and a transportation driver 82.

A plurality of media M are placed on the placement mount 10 depicted in FIG. 1. The placement mount 10 is lifted or lowered by a driving operation performed by the placement-mount lifting-and-lowering driver 81 depicted in FIG. 2. As an example, when the number of media M placed on the placement mount 10 decreases, the control unit 71 may control the placement-mount lifting-and-lowering driver 81 so as to lift the placement mount 10 on the basis of the amount of reflection of light emitted by a light emission unit of a placement-surface detection sensor (not illustrated) in a horizontal direction at a predetermined placement-surface height.

The transportation mechanism 20 includes a transportation belt 21 and pulleys 22 and 23 covered therewith. One of the pulleys 22 and 23 is a drive pulley, and the other is a driven pulley. The drive pulley rotates counterclockwise with reference to FIG. 1 through a driving operation performed by the transportation driver 82 depicted in FIG. 2, thereby rotating the transportation belt 21. Accordingly, the transportation mechanism 20 transports an uppermost medium M1 in a transportation direction D (rightward with reference to FIG. 1).

The transportation belt 21 includes a plurality of through holes through which suction air A1 sucked by the suction mechanism 30 (this mechanism will be described hereinafter) passes.

As an example, a plurality of (e.g., two) transportation mechanisms 20 may be located at the center in the width direction of a medium M that is orthogonal to the transportation direction D, and arranged in the width direction of the medium M. In this case, the suction mechanism 30 (described hereinafter) may suck suction air A1 so as to cause the medium M to be attracted to all of the transportation mechanisms 20. Note that only a single transportation mechanism 20 may be provided.

The transportation mechanism 20 may include another transportation member such as a transportation roller, instead of the transportation belt 21. When the transportation mechanism 20 includes a transportation roller, the transportation driver 82 will rotate the driving roller (transportation roller), not the drive pulley.

The suction mechanism 30 is such that a sucker (not illustrated) (e.g., a fan) sucks suction air A1 through the plurality of through holes provided in the transportation belt 21, thereby causing the uppermost floating medium M1 among the plurality of media M placed on the placement mount 10 to be attracted to the transportation mechanism 20.

The floating-air blowout mechanism 40 is positioned downstream from the plurality of media M placed on the placement mount 10 in the transportation direction D and floats at least the uppermost medium M1 by blowing out floating air A2. The floating-air blowout mechanism 40 may blowout floating air A2 obliquely upward so as to float, for example, about 10 media M, including the uppermost medium M1. Note that two floating-air blowout mechanisms 40 may be disposed to face each other across a medium M in the width direction of the medium M that is orthogonal to the transportation direction D.

The floating-air blowout mechanism 40 includes a fan 41, i.e., an example of an air supply, and a blocking part 42.

Figure 3A:
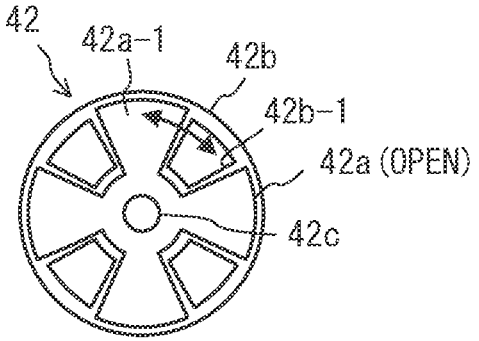
FIG. 3A illustrates a blocking part with a floating air shutter in an open state in an embodiment.

FIG. 3A illustrates the blocking part 42 with a floating air shutter 42*a* in an open state.

Figure 3B:
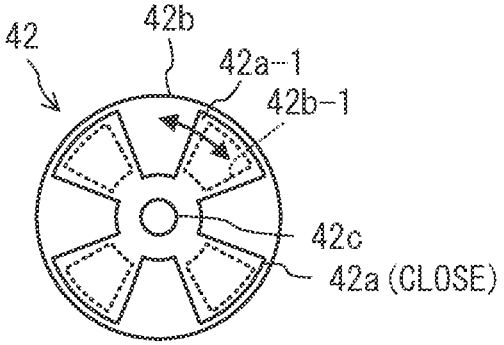
FIG. 3B illustrates a blocking part with a floating air shutter in a closed state in an embodiment.

FIG. 3B illustrates the blocking part 42 with the floating air shutter 42*a* in a closed state.

As depicted in FIG. 3A, the blocking part 42 includes the floating air shutter 42*a*, an opening member 42*b*, and a rotating shaft member 42*c*.

In accordance with a driving operation performed by a shutter driver (not illustrated) (e.g., an actuator such as a motor), the floating air shutter 42*a* swings (rotates) clockwise or counterclockwise by, for example, 45° or less with the rotating shaft member 42*c* as a central axis of rotation.

For example, the floating air shutter 42*a* may include four blades 42*a*-1. The four blades 42*a*-1 are arranged in the rotation direction of the floating air shutter 42*a* at equal spacings (e.g., spacings of 90°).

For example, the opening member 42*b* may assume a disk shape and may be located outward of, and face, the fan 41. The opening member 42*b* may also be disposed in a path of supply of floating air A2 blown out by the floating-air blowout mechanism 40, i.e., a path of supply of floating air A2 between the fan 41 and the air outlet.

The opening member 42*b* includes, for example, four through holes 42*b*-1 through which suction air A2 passes. As with the blades 42*a*-1, the four through holes 42*b*-1 are arranged in the rotation direction of the floating air shutter 42*a* at equal spacings (e.g., spacings of 90°).

The floating air shutter 42*a* swings into the open state in which, as depicted in FIG. 3A, the blades 42*a*-1 do not cover the through holes 42*b*-1 and thus do not block floating air A2 or the closed state depicted in FIG. 3B in which, as depicted in FIG. 3B, the blades 42*a*-1 cover the through holes 42*b*-1 and thus block floating air A2.

The blocking part 42 can block a portion of floating air A2 when the floating air shutter 42*a* is located between the open state depicted in FIG. 3A and the closed state depicted in FIG. 3B and covers portions of the through holes 42*b*-1. In this way, the blocking part 42 can adjust the quantity of floating air A2 in accordance with the position of the floating air shutter 42*a*. A floating air shutter for blocking floating air A2 or adjusting the quantity thereof by moving straight in one direction may also be provided.

Referring again to FIG. 1, the separation-floating-air blowout mechanism 50 is located downstream in the transportation direction D from a plurality of media M placed on the placement mount 10 and blows out separation air A3 for separating an uppermost medium M1 and a second sheet M2 from each other.

The separation-floating-air blowout mechanism 50 includes a fan 51 i.e., an example of an air supply. The separation-floating-air blowout mechanism 50 may also include, as with the floating-air blowout mechanism 40, a blocking part to block separation air A3. Note that two separation-floating-air blowout mechanisms 50 may be disposed to face each other across a medium M in the width direction of the medium M that is orthogonal to the transportation direction D.

The medium detection sensor 60 detects the presence/absence of a medium M placed on the placement mount 10. For example, the medium detection sensor 60 may detect the presence/absence of a medium M placed on the placement mount 10 on the basis of reflection of detection light emitted upward from the upper surface of the placement mount 10.

The control unit 71 depicted in FIG. 2, which is an example of a floating air control unit, includes a processor (e.g., central processing unit (CPU)) that functions as an arithmetic processing apparatus for controlling the operations of the entirety of the medium feeding apparatus 1, and controls the operations of components such as the floating-air blowout mechanism 40. When the medium feeding apparatus 1 is integral with another apparatus such as the printing apparatus 101, a control unit for this apparatus may also serve as the control unit 71.

For example, the storage unit 72 may be a read only memory (ROM) that is a read-only semiconductor memory having a predetermined control program recorded therein in advance, or a random access memory (RAM) that is a randomly writable/readable semiconductor memory used as a working storage region on an as-needed basis when a processor executes various control programs.

The interface unit 73 communicates various information with external devices such as the printing apparatus 101. For example, the interface unit 73 may receive information such as a feeding request or feeding stop request for media M from the control unit for the printing apparatus 101, and the control unit 71 may control the operations of various components of the medium feeding apparatus 1 on the basis of the received information.

The placement-mount lifting-and-lowering driver 81 includes a motor (an example of an actuator) for lifting or lowering the placement mount 10.

The transportation driver 82 includes a motor (an example of an actuator) for rotating the drive pulley, i.e., either of the pulleys 22 and 23 of the transportation mechanism 20.

Next, descriptions are given of the printing apparatus 101 depicted in FIG. 1.

The printing apparatus 101 includes the printing unit 110, a transporter 120, a first feeder 130, a second feeder 140, a third feeder 150, transportation roller pairs 161-165, and a paper-stop-roller pair 166. Thick solid lines in FIG. 1 indicate transportation paths R from the medium feeding apparatus 1, the first feeder 130, the second feeder 140, and the third feeder 150 to the printing unit 110.

For example, the printing unit 110 may include line-head-type inkjet heads (not illustrated) for various colors to be used in printing. The printing unit 110 may use a printing scheme other than the inkjet printing scheme.

The transporter 120 is disposed to face the printing unit 110. For example, the transporter 120 may transport a medium M by means of a transportation belt while attracting the same.

The first feeder 130, the second feeder 140, and the third feeder 150 include feeding trays 131, 141, and 151, scraper rollers 132, 142, and 152, and pickup rollers 133, 143, and 153.

A plurality of media M are placed on the feeding trays 131, 141, and 151.

The scraper rollers 132, 142, and 152 are drawing-out rollers for drawing out and transporting uppermost media M among the plurality of media M placed on the feeding trays 131, 141, and 151.

The pickup rollers 133, 143, and 153 transport media M drawn out by the scraper rollers 132, 142, and 152 to the transportation paths R.

The transportation roller pairs 161-165 are disposed on portions of the transportation paths R extending from the first feeder 130, the second feeder 140, and the third feeder 150 to the paper-stop-roller pair 166.

Media M transported from the medium feeding apparatus 1, the first feeder 130, the second feeder 140, or the third feeder 150 abut the paper-stop-roller pair 166. Thus, skew of the media M is corrected.

The following describes a medium feeding operation performed by the medium feeding apparatus 1 by referring to FIGS. 4-7C.

FIG. 4 is a table for illustrating time lengths p15, p25, and p35 that exceed medium feeding intervals in10, in20, and in 30 for various sizes of media M.

Figure 5:
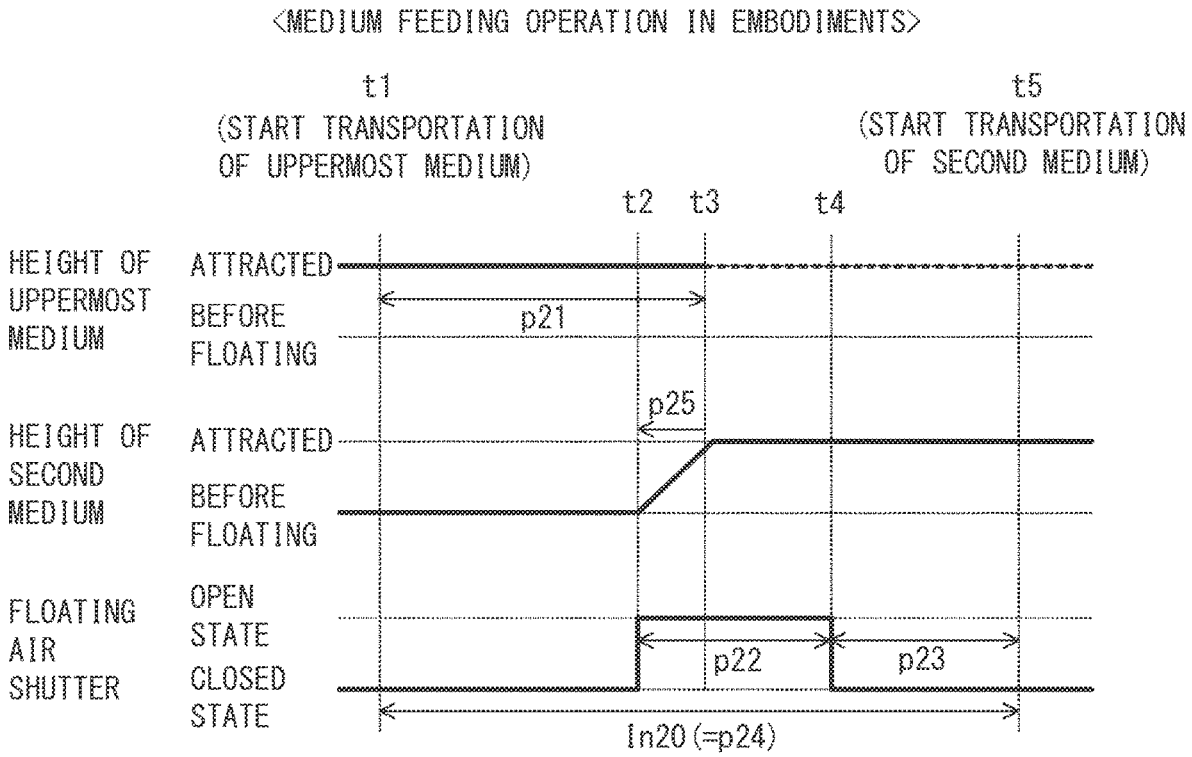
FIG. 5 is a timing chart for illustrating a medium feeding operation in an embodiment.

FIG. 5 is a timing chart for illustrating a medium feeding operation.

Figure 6:
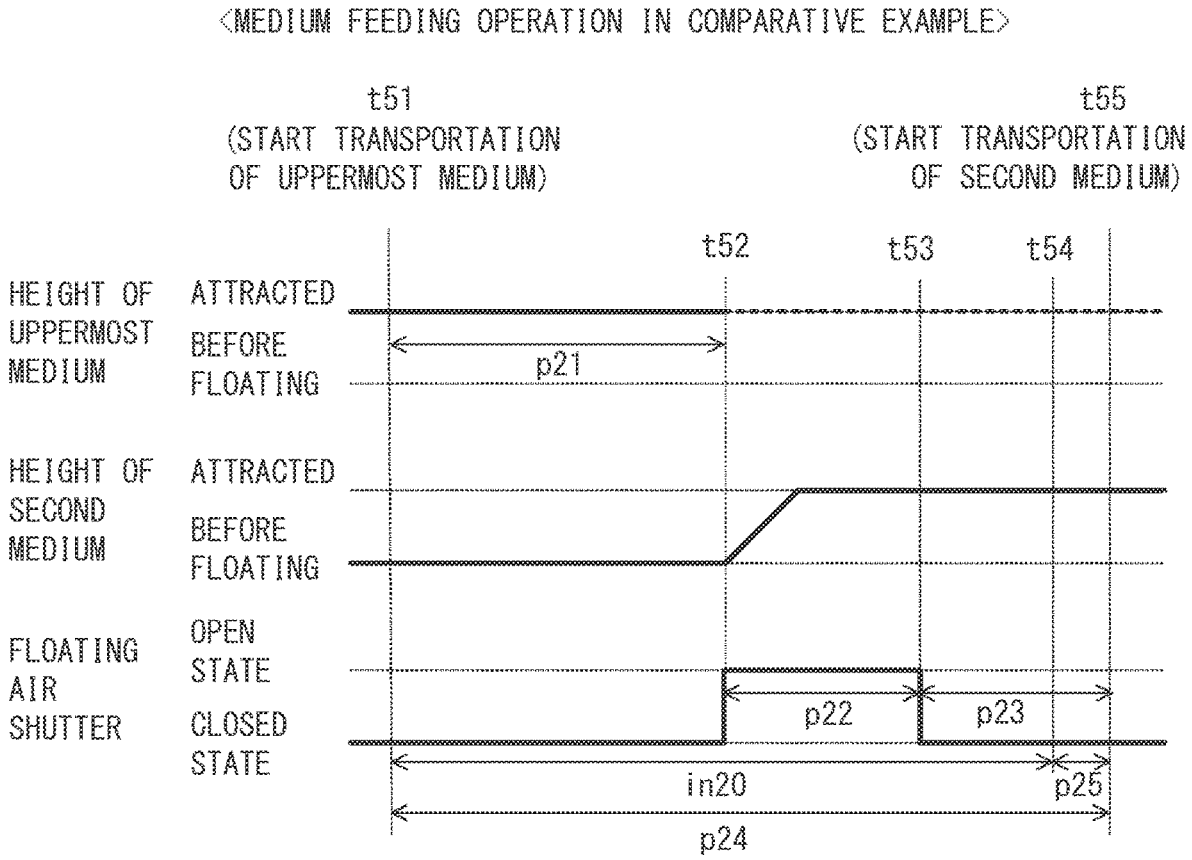
FIG. 6 is a timing chart for illustrating a medium feeding operation in a comparative example.

FIG. 6 is a timing chart for illustrating a medium feeding operation in a comparative example.

Figure 7A:
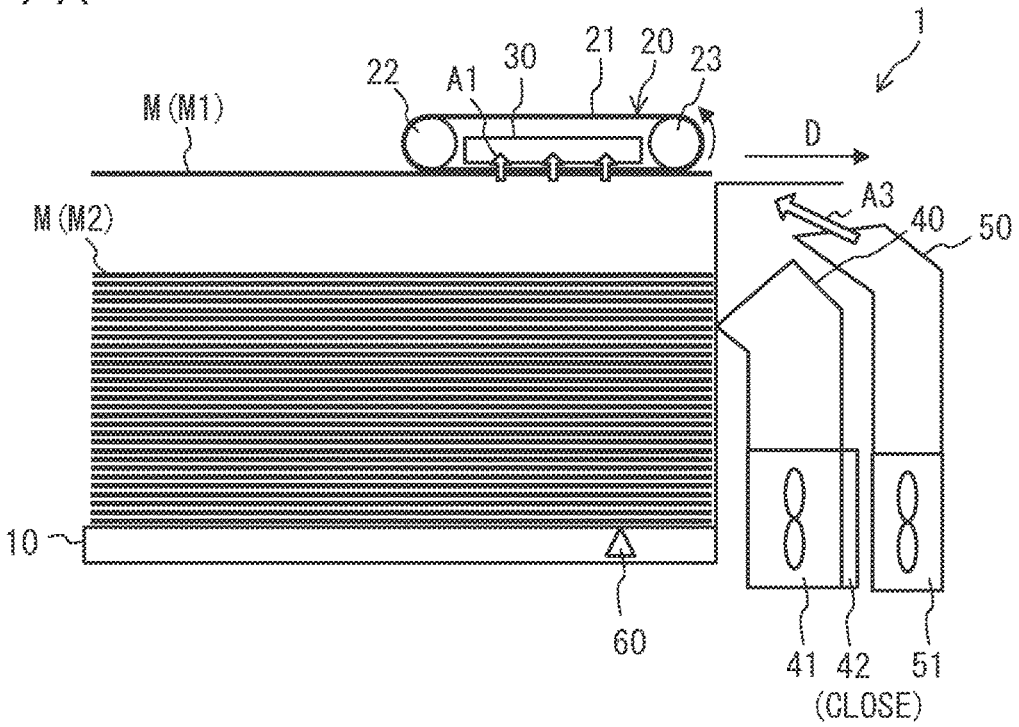
FIG. 7A is an explanatory diagram for a medium feeding operation in an embodiment (example 1)
Figure 7B:
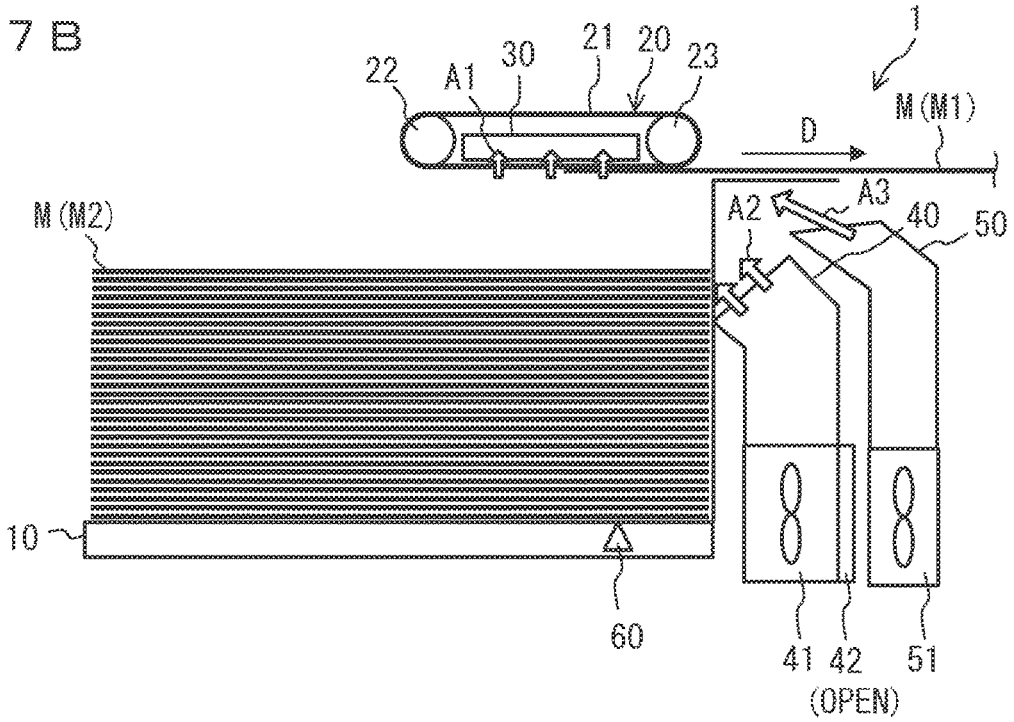
FIG. 7B is an explanatory diagram for a medium feeding operation in an embodiment (example 2)
Figure 7C:
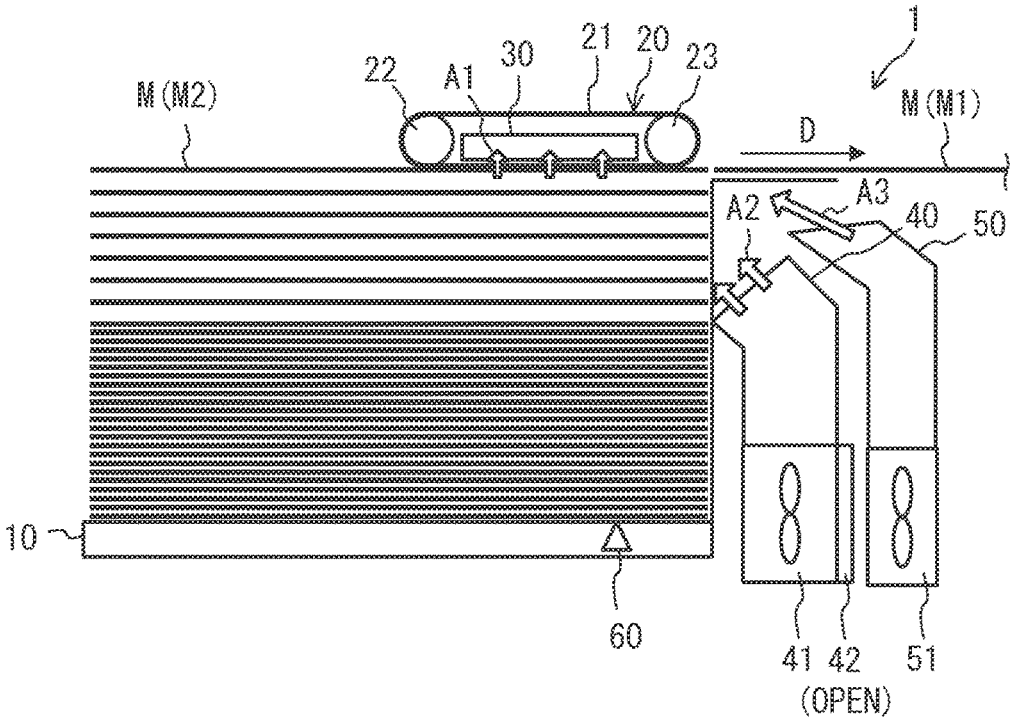
FIG. 7C is an explanatory diagram for a medium feeding operation in an embodiment (example 3)

FIGS. 7A-7C are explanatory diagrams for a medium feeding operation.

The paper quality standard depicted in FIG. 4 indicates that grammage [gsm] is a standard (e.g., 60-100 gsm). "A5" indicates that the size of a medium M is 148 [mm]×210 [mm]. "B5" indicates that the size of a medium M is 182 [mm]×257 [mm]. "A4" indicates that the size of a medium M is 210 [mm]×297 [mm].

Medium feeding intervals in10, in20, and in30 are intervals required to feed media M and may be, for example, intervals provided when media M have the shortest necessary spacings therebetween. Medium feeding intervals in10, in20, and in30 become longer for a larger medium size as media M are longer in the transportation direction D. Accordingly, the medium feeding interval in20 for medium size "B5" is longer than the medium feeding interval in10 for medium size "A5," and the medium feeding interval in30 for medium size "A4" is longer than the medium feeding interval in20 for medium size "B5."

(a) Time lengths p11, p21, and p31, i.e., the lengths of time before a medium M comes to be no longer attracted to the transportation mechanism 20, are each the time length of a period from a point at which the transportation mechanism 20 starts to transport the medium M to a point at which the medium M comes to be no longer attracted. For example, as seen in the comparative example for medium size "B5" depicted in FIG. 6, the time length p21 may be the time length of a period from a time t51 at which the transportation mechanism 20 starts to transport an uppermost medium M1 attracted thereto to a time t52 at which, as indicated by a dashed line, the uppermost medium M1 comes to no longer face, and is thus no longer attracted to, the transportation mechanism 20.

Since the time lengths p11, p21, and p31 also become longer for a larger medium size, the time length p21 for medium size "B5" is longer than the time length p11 for medium size "A5," and the time length p31 for medium size "A4" is longer than the time length p21 for medium size "B5." The time lengths p11, p21, and p31 can be calculated on the basis of the velocity at which the transportation mechanism 20 transports a medium M, the medium size (length in the transportation direction D), and the position of the transportation mechanism 20. However, it may be determined that a medium M has come to be no longer attracted to the transportation mechanism 20 on the basis of a detection result provided by a medium passage sensor (not illustrated) that is located at the position of the end portion of the transportation mechanism 20 on the downstream side in the transportation direction D and detects passage of the medium M.

(b) Time lengths p12, p22, and p32 required for floating are each a length of time for which the floating-air blowout mechanism 40 blows out floating air A2. For example, as depicted in FIG. 6, the time length P22 may be the time length of the period from a time t52 at which the floating air shutter 42*a* is placed into an open state so as to cause a second medium M2 to be attracted to the transportation mechanism 20 to a time t53 at which the floating air shutter 42*a* is placed into a closed state.

(c) Time lengths p13, p23, and p33 required for fall are each a time length required to cause a third and following media M to fall after floating air A2 stops being blown out. For example, as depicted in FIG. 6, the time length p23 may be the time length of a period from the time t53 at which the floating air shutter 42*a* is placed into the closed state to a time t55 at which the transportation mechanism 20 starts to transport the second medium M2 attracted thereto.

Time lengths p14, p24, and p34, i.e., time lengths each required to feed one medium M, are each the sum of values in (a), (b), and (c) described above and thus satisfy "p14=p11+p12+p13," "p24=p21+p22+p23," and "p34=p31+p32+p33." For example, as depicted in FIG. 6, the time length p24 may be the time length of a period from the time t51 at which the uppermost medium M1 starts to be transported to the time t55 at which the second medium M2 starts to be transported.

Time lengths p15, p25, and p35 by which the time lengths p14, p24, and p34, i.e., time lengths each required to feed one medium M, exceed the medium feeding intervals in10, in20, and in30 satisfy "p15=p14−in10," "p25=p24−in20," and "p35=p34−in30." For example, as depicted in FIG. 6, the time length p25 may be a time length by which the time length p24, i.e., the length of time from the time t51 to the time 55, exceeds the medium feeding interval in20 extending from the time 51 at which the uppermost medium M1 starts to be transported to the time t54.

Accordingly, eliminating or reducing the exceeding time length p15, p25, or p35 will allow the efficiency of feeding of media M to be enhanced.

In the embodiment depicted in FIG. 5, accordingly, at time t2, which precedes, by the exceeding time length p25, the time t3 at which the uppermost medium M1 comes to be no longer attracted, the control unit 71 places the floating air shutter 42*a* into the open state to start to blow out floating air A2.

For example, after the transportation mechanism 20 starts to transport the uppermost medium M1 attracted thereto as depicted in FIG. 7A (the time t1 indicated in FIG. 5), the control unit 71 may cause the floating-air blowout mechanism 40 to start to blow out floating air A2 while the uppermost medium M1 is being attracted to the transportation mechanism 20, as depicted in FIG. 7B (the time t2 indicated in FIG. 5). The transportation mechanism 20 is such that when the uppermost medium M1 is nipped by a transportation roller pair (not illustrated) on the transportation path R depicted in FIG. 1, the transportation driver 82 stops being driven before time t2. The separation-air blowout mechanism 50 continues to blow out separation air A3 while media M are being fed.

The control unit 71 causes, as described above, floating air A2 to start to be blown out at the time t2 which precedes the time t3 at which the uppermost medium M1 comes to be no longer attracted, thereby causing, as depicted in FIG. 7C, the second medium M2 to be attracted to the transportation mechanism 20 concurrently with or directly after the uppermost medium M1 coming to be no longer attracted to the transportation mechanism 20 (time t3).

The timing at which the second medium M2 is attracted to the transportation mechanism 20 is desirably, as described above, concurrent with the time at which the uppermost medium M1 comes to be no longer attracted to the transportation mechanism 20, but this timing may precede or follow the time at which the uppermost medium M1 comes to be no longer attracted to the transportation mechanism 20. However, if the timing at which the second medium M2 is attracted to the transportation mechanism 20 excessively precedes the time at which the uppermost medium M1 comes to be no longer attracted to the transportation mechanism 20, a risk of multi-feeding of the uppermost medium M1 and the second medium M2 by the transportation mechanism 20 will increase. Hence, such a timing will desirably be essentially concurrent with the time at which the uppermost medium M1 comes to be no longer attracted to the transportation mechanism 20.

Afterward, the control unit 71 places, as indicated in FIG. 5, the floating air shutter 42*a* in the closed state to stop the blowing out of floating air A2, at the time t4 which follows the time at which the second medium M2 is attracted to the transportation mechanism 20 and precedes the time t5 at which the second medium M2 starts to be transported.

Accordingly, the exceeding time length p25 may be eliminated by matching the time length p24 of the period from the time t1 at which the uppermost medium M1 starts to be transported to the time t5 at which the second medium M2 starts to be transported (a time length required to feed one medium M) with the medium feeding interval in20, or may be reduced by bringing the time length p24 close to the medium feeding interval in20.

In embodiments, the control unit 71 places the floating air shutter 42*a* into the open state at the time t2, which precedes, by the exceeding time length p25, the time t3 at which the uppermost medium M1 comes to be no longer attracted to the transportation mechanism 20. However, the exceeding time length p25 can be reduced by placing the floating air shutter 42*a* into the open state at least a little before the time t3 at which the uppermost medium M1 comes to be no longer attracted to the transportation mechanism 20.

For example, the timing at which the floating-air blowout mechanism 40 starts to blowout the floating air A2 for floating the second medium M2 (a timing at which the floating air shutter 42*a* is placed into the open state), which is determined with reference to the time t3 at which the uppermost medium M1 comes to be no longer attracted to the transportation mechanism 20, or the time length by which the time t2 precedes the time t3, may be adjusted on the basis of media information of media M placed on the placement mount 10.

For example, the media information may be information on the size, orientation, type, or the like of media M. The media information may be obtained by the control unit 71 on the basis of, for example, a print job for the printing apparatus 101, a detection result provided by a sensor (not illustrated) for detecting the size or orientation of media M placed on the placement mount 10, or operations performed in consideration of the type of media M by a user with an operation unit (e.g., lever) provided on the printing apparatus 101. The size of media M may be the "A5," "B5," or "A4" described above. The orientation of media M is a vertical orientation wherein the longitudinal direction of the media M is parallel to the transportation direction D or a horizontal orientation wherein the longitudinal direction of the media M is orthogonal to the transportation direction D. The type of media M may be the thickness (e.g., grammage) thereof or the material therefor, such as plain paper, thick paper, or thin paper.

When, for example, the media M are thick paper, it will take a long time before a medium M floats due to the large mass thereof, and thus a relatively long time length may be set as the time length by which the time at which floating air A2 starts to be blown out (time t2) precedes the time t3 at which the uppermost medium M1 comes to be no longer attracted to the transportation mechanism 20 as indicated in FIG. 5. When the media M are thin paper, in comparison with the case of thick paper, it will not take a long time before a medium M floats due to the small mass thereof, and thus a relatively short time length may be set as the time length by which the time at which floating air A2 starts to be blown out (time t2) precedes the time t3 at which the uppermost medium M1 comes to be no longer attracted to the transportation mechanism 20.

For example, the timing at which the floating-air blowout mechanism 40 starts to blowout the floating air A2 for floating the second medium M2 (a timing at which the floating air shutter 42*a* is placed into the open state), which is determined with reference to the time t3 at which the uppermost medium M1 comes to be no longer attracted to the transportation mechanism 20, may be adjusted on the basis of environment information of the medium feeding apparatus 1 (or both the media information and the environment information).

The environment information may be the humidity, temperature, or airflow in the environment in which the medium feeding apparatus 1 is installed. For example, the environment information may be obtained by the control unit 71 on the basis of a detection result provided by a sensor (not illustrated) provided on the medium feeding apparatus 1. When, for example, the medium feeding apparatus 1 is in a hot and humid environment, it will take a long time before a medium M floats due to the large mass thereof, and thus a relatively long time length may be set as the time length by which the time at which floating air A2 starts to be blown out precedes the time t3 at which the uppermost medium M1 comes to be no longer attracted to the transportation mechanism 20.

Figure 8:
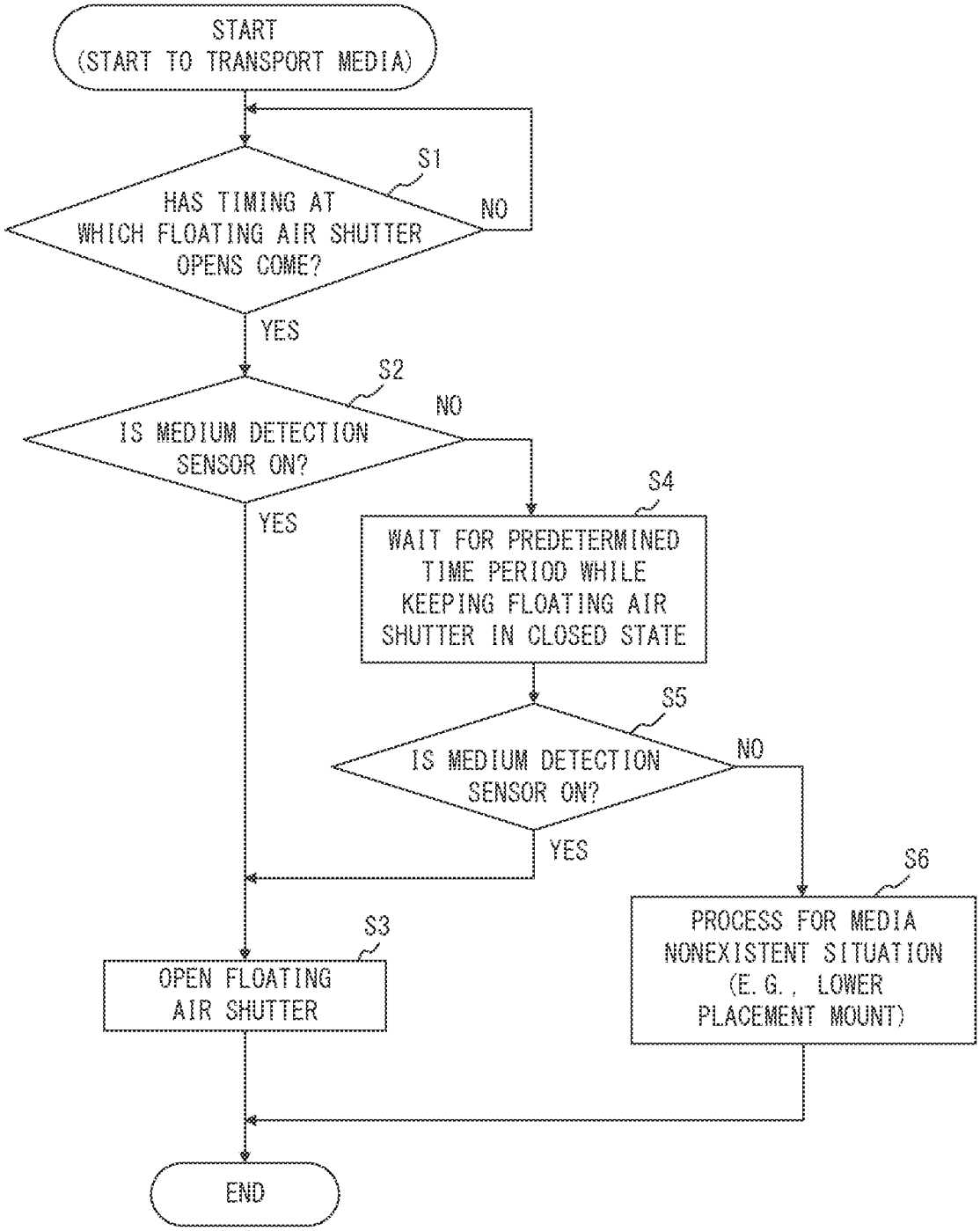
FIG. 8 is a flowchart for illustrating an operation of opening a floating air shutter in a variation of an embodiment.
Figure 9:
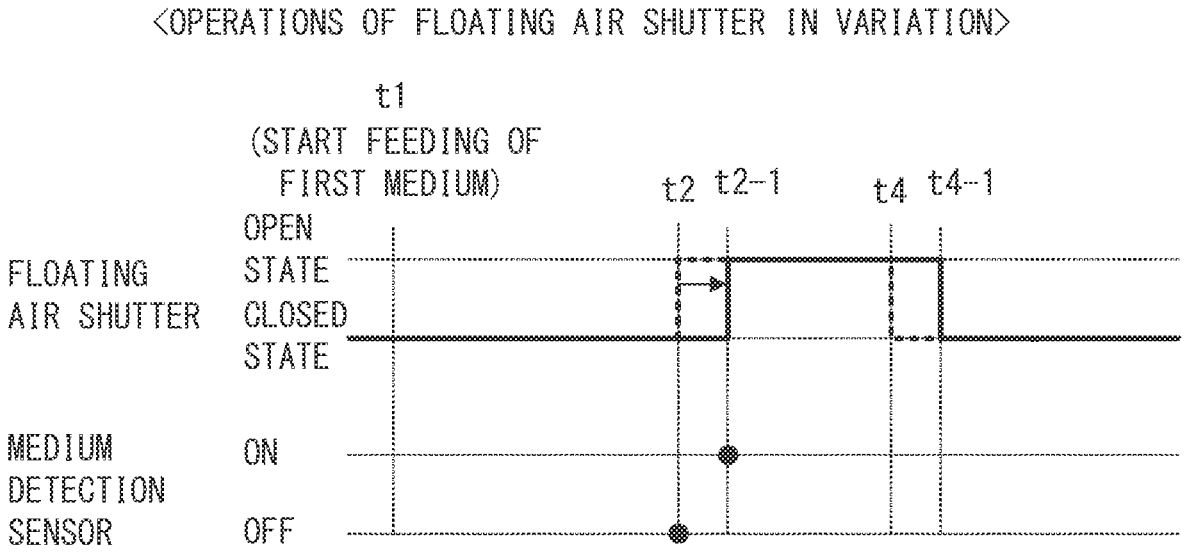
FIG. 9 is a timing chart for illustrating an operation of opening a floating air shutter in a variation of an embodiment.

FIGS. 8 and 9 are a flowchart and a timing chart for illustrating an operation of opening the floating air shutter 42*a* in variations of embodiments.

Even at a timing at which the floating air shutter 42*a* should be placed into the open state, e.g., the time t2 indicated in FIG. 5, as long as the medium detection sensor 60 does not detect that a medium M is located on the placement mount 10, the floating air shutter 42*a* is not placed into the open state, and the floating-air blowout mechanism 40 does not start to blow out floating air A2.

Thus, when starting the processes depicted in FIG. 8 upon a medium M starting to be fed, the control unit 71 first repeatedly determines whether the time t2 depicted in FIGS. 5 and 9, i.e., a timing at which the floating air shutter 42*a* should be placed into the open state, has come (step S1).

When determining that a timing at which the floating air shutter 42*a* should be placed into the open state has come (step S1: YES), the control unit 71 determines whether the medium detection sensor 60 has detected that there is a medium M placed on the placement mount 10 (step S2).

When the medium detection sensor 60 has detected that there is a medium M placed on the placement mount 10 (step S2: YES), the control unit 71 causes the floating-air blowout mechanism 40 to start to blow out floating air A2 by placing the floating air shutter 42*a* into the open state at time t2 (step S3) as indicated by a dashed line in FIG. 9. Then, the blowing out of floating air A2 ends at time t4 as indicated by a dashed line in FIG. 9, thereby finishing the processes depicted in FIG. 8. Afterward, when the floating air shutter 42*a* is closed (time t4), the processes depicted in FIG. 8 may be performed again starting from step S1.

When the medium detection sensor 60 detects that there are no media M placed on the placement mount 10 (step S2: NO), the control unit 71 waits for a predetermined time period while keeping the floating air shutter 42*a* in the closed state (step S4). For example, the control unit 71 may wait without placing the floating air shutter 42*a* into the open state for the predetermined time period from the time t2 to the time t2-1 depicted in FIG. 9.

After the predetermined time period has elapsed (at the time t2-1 indicated in FIG. 9), the control unit 71 determines again whether the medium detection sensor 60 has detected that there is a medium M placed on the placement mount 10 (step S5).

When, as indicated in FIG. 9, the medium detection sensor 60 detects at time t2-1 that there is a medium M placed on the placement mount 10 (step S5: YES), the control unit 71 causes the floating-air blowout mechanism 40 to start to blow out floating air A2 by opening the floating air shutter 42*a* at time t2-1 (step S3), as indicated by a dashed line in FIG. 9. Then, the blowing out of floating air A2 ends at time t4-1, which follows time t4.

When the medium detection sensor 60 detects again that there are no media M placed on the placement mount 10 (step S5: NO), the control unit 71 causes the floating-air blowout mechanism 40 to cancel the start of blowout of floating air A2 but performs processes for a situation in which no media M have been placed on the placement mount 10, e.g., controls the placement-mount lifting-and-lowering driver 81 so as to lower the placement mount 10 to a lowermost position, thereby finishing the processes depicted in FIG. 8.

In the embodiments described so far, the medium feeding apparatus 1 includes the placement mount 10, the transportation mechanism 20, the floating-air blowout mechanism 40, the suction mechanism 30, and the control unit 71. A plurality of media M are placed on the placement mount 10. The transportation mechanism 20 transports the uppermost medium M1 of the plurality of media placed on the placement mount 10. The floating-air blowout mechanism 40 floats at least the uppermost medium M1 by blowing out floating air A2. The suction mechanism 30 sucks suction air A1 to cause the uppermost medium M1 floated by the floating-air blowout mechanism 40 blowing out floating air A2 to be attracted to the transportation mechanism 20. The control unit 71 causes the floating-air blowout mechanism 40 to start to blow out floating air A2 while the uppermost medium M1 is being attracted to the transportation mechanism 20 after starting to be transported by the transportation mechanism 20, so as to float at least a second medium M2 located below the uppermost medium M1, and causes the floating-air blowout mechanism 40 to stop blowing out floating air A2 before the second medium M2 starts to be transported by the transportation mechanism 20.

Accordingly, in comparison to when, as seen in the comparative example depicted in FIG. 6, floating air A2 starts to be blown out upon the floating air shutter 42*a* being placed into the open state at the time t52 at which the uppermost medium M comes to be no longer attracted, floating air A2 can start to be blown out, as indicated in FIG. 5, upon the floating air shutter 42*a* being placed into the open state at the time t2 that precedes the time t3 at which the uppermost medium M comes to be no longer attracted. Thus, the time length p24, i.e., a time length required to feed one medium M, can be shortened as in aspects in which a plurality of media M are transported in a state of being laid one on top of another (conventionally used examples). Hence, multi-feeding, which tends to occur when a plurality of media M are transported in a state of being laid one on top of another, can be prevented from occurring. In addition, components or control operations that would be essential to block suction air A1 produced by the suction mechanism 30 when transporting a plurality of media M in a state of being laid one on top of another can be omitted. As a result, embodiments can enhance the efficiency of feeding of media M while preventing multi-feeding of media M by means of a simple configuration.

In embodiments, on the basis of media information of media M placed on the placement mount 10, the control unit 71 adjusts the timing at which the floating-air blowout mechanism 40 starts to blow out floating air A2 to float the second medium M2 (time t2).

Accordingly, for example, for media M such as thick paper, which would require a long time before being floated, a relatively long time length may be set as the time length by which the time at which floating air A2 starts to be blown out precedes the time t3 at which the uppermost medium M1 comes to be no longer attracted to the transportation mechanism 20; and for media M such as thin paper, which would require a short time before being floated, a relatively short time length may be set as the time length by which the time at which floating air A2 starts to be blown out precedes the time t3 at which the uppermost medium M1 comes to be no longer attracted to the transportation mechanism 20. Hence, the time length p24 required to feed one medium M can be shortened in consideration of the time required to float media M.

In embodiments, the medium feeding apparatus 1 includes the medium detection sensor 60 that detects the presence/absence of a medium M placed on the placement mount 10. When the medium detection sensor 60 has detected that there is a medium M placed on the placement mount 10, the control unit 71 causes the floating-air blowout mechanism 40 to start to blow out floating air A2. When the medium detection sensor 60 has detected that there are no media M placed on the placement mount 10, the control unit 71 causes the floating-air blowout mechanism 40 to stop the start of blowout of floating air A2; and after elapse of a predetermined time period, when the medium detection sensor 60 has detected again that there are no media M placed on the placement mount 10, the control unit 71 causes the floating-air blowout mechanism 40 to cancel the start of blowout of floating air A2.

In the meantime, since the floating-air blowout mechanism 40 starts to blow out floating air A2 at a timing (time t2) prior to the time at which the uppermost medium M1 comes to be no longer attracted to the transportation mechanism 20 (time t3), when floating air A2 starts to be blown out, a medium M that was floating due to the previous blowing out of floating air A2 could be in the process of falling. In this case, even if the medium detection sensor 60 erroneously detects that there are no media M placed on the placement mount 10, the medium detection sensor 60, after elapse of the predetermined time period, again detects the presence/absence of a medium M, so that the erroneous detection can be suppressed because the medium M would completely fall before the predetermined time period elapses.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates, as appendixes, the invention set forth in the claims of the corresponding Japanese application as originally filed.

A first medium feeding apparatus comprising:

a placement mount on which a plurality of media are placed;

a transportation mechanism that transports an uppermost medium of the plurality of media placed on the placement mount;

a floating-air blowout mechanism that blows out air to float at least the uppermost medium;

a suction mechanism that sucks air to cause the uppermost medium floated by the floating-air blowout mechanism blowing out air to be attracted to the transportation mechanism; and a control unit that causes the floating-air blowout mechanism to start to blow out air while the uppermost medium is being attracted to the transportation mechanism after starting to be transported by the transportation mechanism, so as to float at least a second medium located below the uppermost medium, and causes the floating-air blowout mechanism to stop blowing out air before the second medium starts to be transported by the transportation mechanism.

A second medium feeding apparatus corresponding to the first medium feeding apparatus, wherein on the basis of media information of the media placed on the placement mount, the control unit adjusts a timing at which the floating-air blowout mechanism starts to blow out air to float the second medium.

A third medium feeding apparatus corresponding to the first or second medium feeding apparatus, further comprising:

a medium detection sensor that detects presence/absence of a medium placed on the placement mount, wherein the control unit causes the floating-air blowout mechanism to start to blow out air when the medium detection sensor has detected that there is a medium placed on the placement mount, and when the medium detection sensor has detected that there are no media placed on the placement mount, the control unit causes the floating-air blowout mechanism to stop start of blowout of air, and after elapse of a predetermined time period, when the medium detection sensor has detected again that there are no media placed on the placement mount, the control unit causes the floating-air blowout mechanism to cancel start of blowout of air.

What is claimed is:

1. A medium feeding apparatus comprising:

a placement mount on which a plurality of media are placed;

a transportation mechanism that transports an uppermost medium of the plurality of media placed on the placement mount;

a floating-air blowout mechanism that blows out air to float at least the uppermost medium;

a suction mechanism that sucks air to cause the uppermost medium floated by the floating-air blowout mechanism blowing out air to be attracted to the transportation mechanism; and a floating-air control unit that causes the floating-air blowout mechanism to start to blow out air, from a state in which no air is blown, while the uppermost medium is being attracted to the transportation mechanism after starting to be transported by the transportation mechanism, so as to float at least a second medium located below the uppermost medium, and causes the floating-air blowout mechanism to stop blowing out air before the second medium starts to be transported by the transportation mechanism.

2. The medium feeding apparatus of claim 1, wherein on the basis of media information of the media placed on the placement mount, the floating-air control unit adjusts a timing at which the floating-air blowout mechanism starts to blow out air to float the second medium.

3. The medium feeding apparatus of claim 2, wherein the media information includes information of an orientation of the plurality of media.

4. The medium feeding apparatus of claim 1, further comprising:

a medium detection sensor that detects presence/absence of a medium placed on the placement mount, wherein the floating-air control unit causes the floating-air blowout mechanism to start to blow out air when the medium detection sensor has detected that there is a medium placed on the placement mount, and when the medium detection sensor has detected that there are no media placed on the placement mount, the floating-air control unit causes the floating-air blowout mechanism to stop start of blowout of air, and after elapse of a predetermined time period, when the medium detection sensor has detected again that there are no media placed on the placement mount, the floating-air control unit causes the floating-air blowout mechanism to cancel start of blowout of air.

5. The medium feeding apparatus of claim 1, wherein the floating-air control unit causes the floating-air to start to be blown out to cause the second medium to be attracted to the transportation mechanism concurrently with the uppermost medium coming to be no longer attracted to the transportation mechanism.

6. The medium feeding apparatus of claim 1, wherein on the basis of environment information of the plurality of media placed on the placement mount, the floating-air control unit adjusts a timing at which the floating-air blowout mechanism starts to blow out air to float the second medium.

7. A medium feeding apparatus comprising:

a placement mount on which a plurality of media are placed;

a transportation mechanism that transports an uppermost medium of the plurality of media placed on the placement mount;

a floating-air blowout mechanism that blows out air to float the plurality of media including the uppermost medium;

a separation-floating-air blowout mechanism that blows out separation air to separate the uppermost medium from a second medium adjacent and below the uppermost medium;

a suction mechanism that sucks air to cause the uppermost medium floated by the floating-air blowout mechanism blowing out air to be attracted to the transportation mechanism; and a floating-air control unit that causes the floating air blowout mechanism to start to blow out air while the uppermost medium is being attracted to the transportation mechanism after the transportation mechanism starts to transport the uppermost medium, so as to float at least a second medium located below the uppermost medium, and to stop blowing out air before the second medium starts to be transported by the transportation mechanism.

8. The medium feeding apparatus of claim 7, wherein on the basis of media information of the media placed on the placement mount, the floating-air control unit adjusts a timing at which the floating-air blowout mechanism starts to blow out air to float the second medium.

9. The medium feeding apparatus of claim 8, wherein the media information includes information of an orientation of the plurality of media.

10. The medium feeding apparatus of claim 7, further comprising:

a medium detection sensor that detects presence/absence of a medium placed on the placement mount, wherein the floating-air control unit causes the floating-air blowout mechanism to start to blow out air when the medium detection sensor has detected that there is a medium placed on the placement mount, and when the medium detection sensor has detected that there are no media placed on the placement mount, the floating-air control unit causes the floating-air blowout mechanism to stop start of blowout of air, and after elapse of a predetermined time period, when the medium detection sensor has detected again that there are no media placed on the placement mount, the floating-air control unit causes the floating-air blowout mechanism to cancel start of blowout of air.

11. The medium feeding apparatus of claim 7, wherein the floating-air control unit causes the floating-air to start to be blown out to cause the second medium to be attracted to the transportation mechanism concurrently with the uppermost medium coming to be no longer attracted to the transportation mechanism.

12. The medium feeding apparatus of claim 7, wherein on the basis of environment information of the media placed on the placement mount, the floating-air control unit adjusts a timing at which the floating-air blowout mechanism starts to blow out air to float the second medium.

13. The medium feeding apparatus of claim 7, wherein the separation-floating-air blowout mechanism is positioned downstream of the floating-air blowout mechanism in a transportation direction of the plurality of media by the transportation mechanism.

14. The medium feeding apparatus of claim 7, wherein the separation-floating-air blowout mechanism and the floating-air blowout mechanism each include a blocking part having an open state and a closed state, and wherein when the blocking parts of the separation-floating-air blowout mechanism and the floating-air blowout mechanism are in the closed state, the blocking parts respectively block air from blowing from the separation-floating-air blowout mechanism and the floating-air blowout mechanism.

15. The medium feeding apparatus of claim 7, wherein the apparatus includes two separation-floating-air blowout mechanisms disposed to face each other across the media in the width direction of the media orthogonal to a transportation direction in which the transportation mechanism transports the media.

16. The medium feeding apparatus of claim 7, wherein the separation-floating-air blowout mechanism continues to blow out separation air while the media are being fed from the placement mount.

17. The medium feeding apparatus of claim 7, wherein the separation-floating-air blowout mechanism is positioned downstream of the placement mount in a transportation direction of the plurality of media by the transportation mechanism.

18. The medium feeding apparatus of claim 7, wherein the separation-floating-air blowout mechanism includes a fan to blow the air from the separation-floating-air blowout mechanism.

19. The medium feeding apparatus of claim 7, wherein the separation-floating-air blowout mechanism is positioned downstream of the floating-air blowout mechanism in a transportation direction of the plurality of media by the transportation mechanism, the separation-floating-air blowout mechanism and the floating-air blowout mechanism both include a blocking part having an open state and a closed state, when the blocking parts of the separation-floating-air blowout mechanism and the floating-air blowout mechanism are in the closed state, the blocking parts respectively block air from blowing from the separation-floating-air blowout mechanism and the floating-air blowout mechanism, the apparatus further includes two separation-floating-air blowout mechanisms disposed to face each other across the media in the width direction of the media orthogonal to a transportation direction in which the transportation mechanism transports the media, the separation-floating-air blowout mechanism continues to blow out separation air while the media are being fed from the placement mount by a feeding mechanism, the separation-floating-air blowout mechanism is positioned downstream of the placement mount in a transportation direction of the plurality of media by the transportation mechanism, and the separation-floating-air blowout mechanism includes a fan to blow the air from the separation-floating-air blowout mechanism.

* * * * *